United States Patent [19]

Chierici

[11] 4,079,818

[45] Mar. 21, 1978

[54] BRAKE ROD SUPPORT ARRANGEMENT FOR RAILROAD CARS

[75] Inventor: Osvaldo F. Chierici, Elmhurst, Ill.

[73] Assignee: Holland Company, Lombard, Ill.

[21] Appl. No.: 785,869

[22] Filed: Apr. 7, 1977

[51] Int. Cl.[2] ..... F16D 65/02; B61H 13/38

[52] U.S. Cl. ..... 188/207; 74/579 R; 188/219.1

[58] Field of Search ..... 74/579 R, 608; 188/207, 188/210, 212, 214, 219.1

[56] References Cited

U.S. PATENT DOCUMENTS

| | | | |
|---|---|---|---|
| 1,211,763 | 1/1917 | Schaefer | 74/579 R |
| 1,240,493 | 9/1917 | Schaefer | 74/579 R |

*Primary Examiner*—Duane A. Reger
*Attorney, Agent, or Firm*—McWilliams & Mann

[57] ABSTRACT

A support arrangement for brake rods of railroad car brake rigging comprising a U-shaped support member suspended from the underside of the car, a slotted sleeve snap fitted on the brake rod and located to rest on the bight portion of the support member, with the slot facing upwardly, and a retainer member comprising a shank portion received in said slot and having its end portions extending beyond the ends of the sleeve and enlarged to embrace the upwardly facing side of the brake rod on either side of the sleeve slot, with the retainer member end portions being bonded to the brake rod. The sleeve is formed from an ultra high molecular weight polymer material that is of dry self-lubricating nature and resists adherence thereto of foreign materials and serves as a sound deadener and energy absorber. Such material is also characterized by its polishing action on the brake rod support surface it rides on to reform same to define a mirror finish that substantially inhibits further wear on the support during use.

15 Claims, 7 Drawing Figures

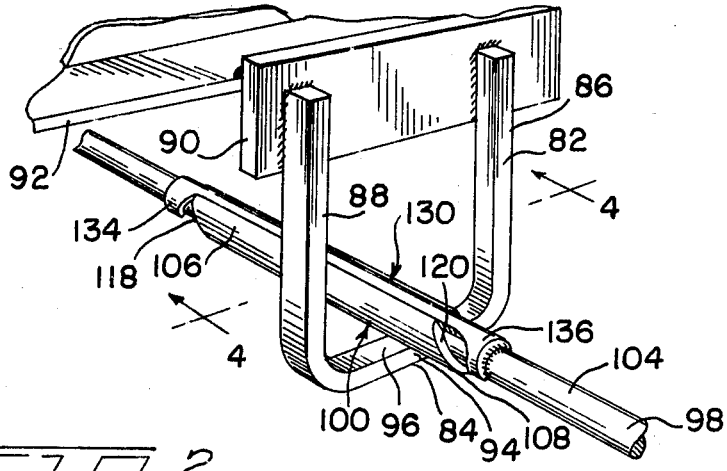
FIG. 2
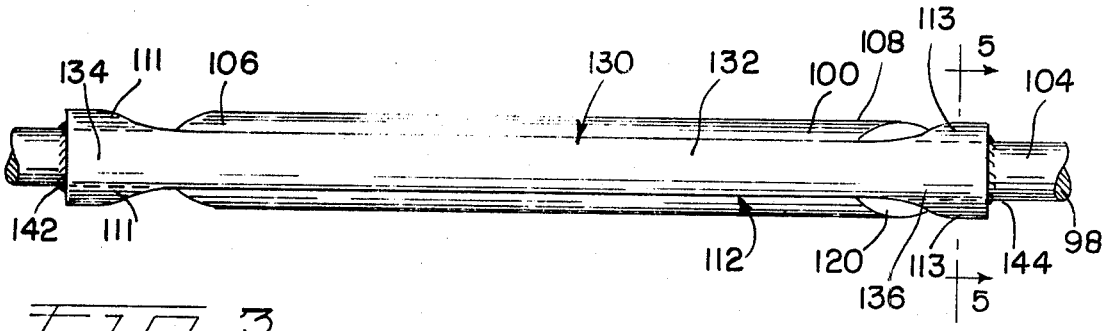
FIG. 3
FIG. 4
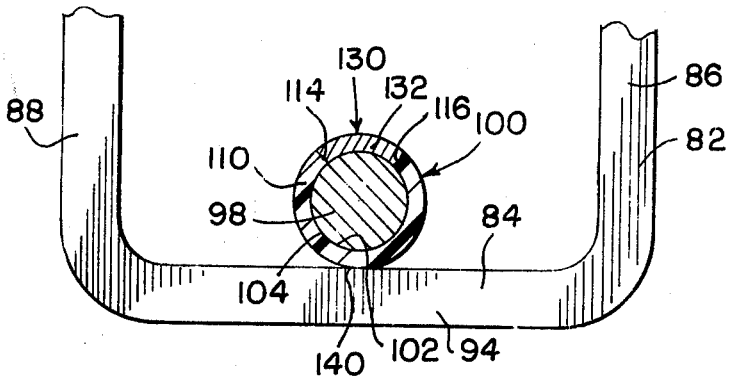
FIG. 1
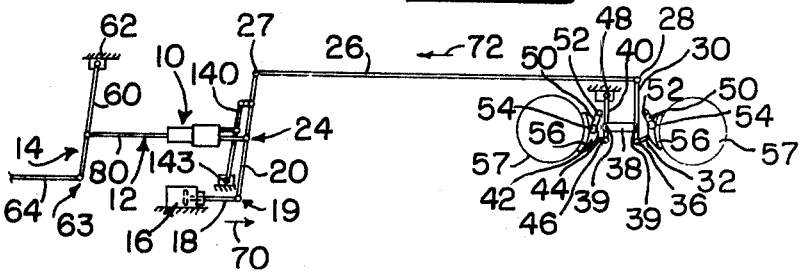

BRAKE ROD SUPPORT ARRANGEMENT FOR RAILROAD CARS

This invention relates to supports for brake rods of railway car foundation brake gear, commonly referred to as brake rigging, and more particularly, to a brake rod support arrangement that accommodates the movement that brake rods must make when the car brakes are applied while protecting the brake rod and support therefor from wear in the area of same where the rod is supported.

The brake rigging of railroad cars conventionally includes cylinder and dead levers swingably mounted under the car for actuation by a brake cylinder, with the levers being operably connected to the truck wheel brake mechanisms through linkages that include the familiar brake rod. Brake rods are long metal rods of either $\frac{7}{8}$ inch or 1 inch in diameter thickness that are molded longitudinally thereof in one direction a distance in the range of 6 to 7 inches, under the action of the brake cylinder in applying the brakes, and are returned to their riding positions under the weight of the truck brake beams and their swinging mounting hangers whereby the brake beams swing away from the truck wheels when the brakes are released.

Brake rod wear and repair presents a long standing maintenance problem in the railroad field. Brake rods are oridinarily supported intermediate their ends by resting on a wear plate that is suitably suspended or supported from the underside of the car, with the brake rod being in metal to metal contact with the support wear plate. As the car brakes are ordinarily released when the car is in motion, the rigging brake rods are free to vibrate, and vibration of same is readily induced by similar car body motion occasioned by car movement along the track. Thus, the brake rods are subject to considerable wear at the portion of same that engage the brake rod support wear plates due to the rattling of the brake rods against the wear plate involved as well as the support therefor and any movement restraining structures that may frequently are applied to support to cut down on the rattling action of the brake rod. The brake rod vibration problem is particularly severe when the car rides empty.

Another serious source of wear on brake rods at the same location is that when the brakes are applied and released, the rods slide back and forth on their supports, and are under a downwardly directed thrust action that presses them against the wear plate of their supports. As cars are frequently braked up to as much as 10 percent of the braking travel action available, when moving as part of a train, wear tendencies due to normal application of the brakes are also considerable in addition to those occasioned by brake rod rattle due to vibration.

AAR Regulations require that when brake rods at the location of their supports have been reduced by wear to a thickness of approximately $\frac{3}{4}$ of an inch, such rods have reached a condemnation point, which requires shopping of the car (with the consequent down time for the car) to either replace the entire rod or replace the worn segment of the rod, using flash welding procedures and grinding the weld joints smooth. AAR Regulations prohibit field welding of brake rods to repair same.

The indicated wear problem is particularly acute in connection with high mileage cars such as those used in unit trains, where the cars may travel 120,000 to 160,000 miles per year. The brake rod rattle problem in caboose provide a brake rod support arrangement that not only alleviates the brake rod wear problem, but also renders brake rods essentially wear free at their troublesome support locations.

Another principal object of the invention is to provide a support arrangement for brake rods that can be readily applied in the field and to partially worn brake rods.

Other objects of the invention are to provide a wear resisting brake rod support arrangement that is economical of manufacture, easy to apply using relatively unskilled labor, and long lived in use.

In accordance with the present invention, a support arrangement for brake rods of railway car brake rigging is provided comprising a U-shaped support member suspended from the underside of the car, a slotted wear resisting sleeve snap fitted on the brake rod from the side thereof and located to rest on the bight portion of the support member, with the sleeve slot facing upwardly, and a retainer member comprising a shank portion received in said slot and having its end portions extending beyond the ends of the sleeve and enlarged to embrace the upwardly facing side of the brake rod on either side of the sleeve slot, with the retainer member end portions being bonded to the brake rod to fix the sleeve against any substantial movement relative to the brake rod.

The sleeve is formed from an ultra high molecular weight polymer material, namely polyethylene or its equivalent. This material is of dry self-lubricating nature and resists adherence thereto of foreign material. The material from which the sleeve is formed is also characterized by its resurfacing action on the support on which it rides to reform same to define a mirror finish for inhibiting any substantial wear of the support at this location during use. The sleeve also serves as a sound deadener and energy absorber.

The sleeve is proportioned in length to rest on and maintain engagment with the brake rod support at all positions of the brake rod relative thereto in the travel range of the brake rod relative to the support. The support itself may be in the form of the familiar U-shaped brake rod support member affixed to the underside of the car in upright position to define a lower bight portion on which the brake rod rests with the wear resisting sleeve of same in contact with the support. The familiar brake rod support wear plate and rattle restraining components are eliminated as unnecessary in accordance with the present invention.

Other objects, uses, and advantages will be obvious or become apparent from a consideration of the following detailed description and the application drawings in which like reference numerals indicate like parts throughout the several views.

In the drawings:

FIG. 1 is a diagrammatic view illustrating a typical brake rigging arrangement to which the brake rod support of this application is directly applicable;

FIG. 2 is a fragmental perspective view illustrating one embodiment of the invention and a fragment of a conventional brake rod to which the invention is applied;

FIG. 3 is a plan view of the brake rod fragment shown in FIG. 2 further illustrating the brake rod support wear resisting sleeve and retainer therefor;

FIG. 4 is a view substantially along line 4—4 of FIG. 2;

Figure 5:
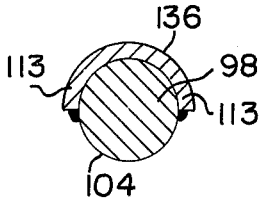
FIG. 5 is a sectional view taken substantially along line 5—5 of FIG. 3.

However, it is to be distinctly understood that the specific drawing illustrations provided are supplied primarily to comply with the requirements of the Patent Laws, and that the invention is susceptible of other embodiments that will be obvious to those skilled in the art, and which are intended to be covered by the appended claims.

Reference numeral 14 of FIG. 1 generally indicates a diagrammatically illustrated foundation brake gear or brake rigging arrangement of a familiar type to which the invention is directly applicable, comprising the usual air actuated brake cylinder 16 that is secured to the car in any suitable manner and includes a thrust or piston rod 18 that is pivotally connected as at 19 to a cylinder or live lever 20, which is in turn pivotally connected to center rod structure 12 as at 24 and brake rod 26 as at 27 that extends to one of the car trucks, where the rod 26 may be pivotally connected as at 28 to the actuating truck lever 30 that operates one of the brake beams 32 through a link 34 that is pivotally connected to the lever 30 as at 36. The truck lever 30 is connected to truck dead lever 40 by link 38 and pivotal joints 39, and lever 40 is connected to the other brake beam 42 by link 44 (the link 44 being pivotally connected to the lever 40 by pivotal joint 46) and with the lever 40 being pivotally anchored to the car truck structure as at 48.

The brake beams 32 and 42 are customarily suspended from the truck by conventional hanger members 50 that are pivoted to the truck as at 52, and to the brake beam as at 54, respectively and, of course, the brake beams 32 and 42 each carry the diagrammatically illustrated brake shoes 56 which are to bear against the diagrammatically illustrated truck wheels 57 for braking purposes.

The center rod structure 12, which in the form shown includes diagrammatically illustrated brake adjuster 10, is also pivotally connected as at 61 to the rigging dead lever 60 which is fulcrumed in any suitable manner to the car structure, as at 62, and is pivotally connected as at 63 to brake rod 64, which is in turn operatively connected with the truck brake apparatus of the car other truck in a manner similar to that shown at the right hand side of FIG. 1.

As is well known in the art, when a braking of the car is to be effected, the brake cylinder 16 is actuated to move the thrust or piston rod 18 to the right of FIG. 1, or in the direction of the arrow 70, which tends to throw the cylinder lever 20 counterclockwise about the pivotal connection 24 between it and the center rod structure 12. Likewise, this motion tends to move the brake rod 26 to the left of FIG. 1 and in the direction of the arrow 72 to swing the truck lever 30 in a manner to force brake shoes 56 against the diagrammatically illustrated truck wheels 57. The car brakes are in effect released when the air is released from the brake cylinder 16 in a conventional manner due to the fact that the weight of the brake beams 32 and 42 tends to swing them away from the respective wheels 57 about the pivotal hanger mountings 52, which thus causes the brake rod 26, the cylinder lever 20 and the thrust or piston rod 18 to move in directions opposite to those indicated by the arrows 70 and 72.

Of course, the connection of the center rod structure 12 with dead lever 60 actuates the lever 60, brake rod 64, and the truck braking apparatus it is connected to in a manner that is similar to that described with regard to the truck brake apparatus shown in FIG. 1.

Referring now to FIGS. 2 through 5, reference numeral 80 generally indicates a brake rod support arrangement in accordance with the present invention that is applied to the car body underside to support the brake rods 26 and 64 at one or more positions intermediate their ends, depending on the length of the respective brake rods for a particular car.

In the form shown, the support arrangement 80 comprises a support member 82 of U-shaped configuration defining a bight portion 84 that is integral with upstanding rectilinear leg portions 86 and 88. The leg portions 86 and 88 are affixed by welding to mounting plate 90 that in turn is fixed by welding to, for instance, a cross bearer 92 of the car body underframe.

The support member 82 is thus disposed with its leg portions 86 and 88 vertically positioned. Support member 82 in the form shown has the mid portion 94 of bight portion 84 of rectilinear configuration and horizontally disposed, to define a support surface 96 on which the brake rod in question is supported. In the showing of FIGS. 2 through 5, the brake rod segment 98 that is shown may be considered a portion of either brake rod 26 or 64.

Further in accordance with the invention, the support arrangement 80 contemplates that brake rod segment 98 has applied thereto a sleeve 100 of special characteristics that is formed from the high density polymer hereinafter described. Sleeve 100 is proportioned such that its bore 102 substantially complements the external surfacing 104 of the rod segment 98, to the extent that the bore 102 has an internal diameter that is substantially equivalent to the nominal external diameter of rod segment 98. In addition, the sleeve 100 is proportioned to extend lengthwise of the rod segment 98, to either side of the support member 82, a sufficient amount so that at either end of the travel range of the rod segment 98 relative to support member 82, the respective ends 106 and 108 of the sleeve 100 will not enter in between the arms 86 and 88 of support member 82.

The sleeve encompassing sidewall 110 is formed to define elongate slot 112 that extends longitudinally of the sleeve 100 and defines radially disposed cam surfaces 114 and 116 which have a spacing from each other, with reference to the external diameter of the rod surfacing 104, such that the sleeve 100 can be applied to the rod segment 98 by snap fitting same onto the rod segment 98 from one side of the rod segment. For this purpose, the slot 112 is proportioned to define a void along sidewall 110 that extends approximately one fourth of its circumference.

Operably associated with the sleeve 110 is retainer member 130 which comprises a rectilinear shank portion 132 that is proportioned lengthwise of same and in tranverse section to substantially fill the slot 112 of sleeve 100, when the sleeve 100 has been applied to the rod segment 98, and be lodged in the slot 112 in complementing relation to the sleeve sidewall 110 and external surfacing 104 of the rod segment 98. The retainer member 130 also defines end portions 134 and 136 that are enlarged circumferentially to define the respective pairs of shoulders 111 and 113 that, shape retainer ends 134 and 136 to embrace approximately one-half the external surfacing 104 of the rod segment 98, as indicated in FIG. 5.

Figure 6:
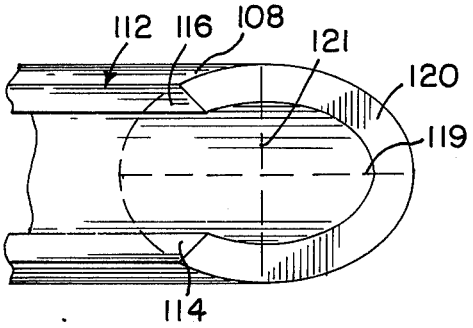
FIG. 6 is a view of one end of the wear resisting sleeve, looking at right angles to the plane of one of the angled ends of same.

The sleeve 100 at its ends 106 and 108 is formed to define planar end surfaces 118 and 120 respectively that are in parallelism and are inclined at 45° with respect to the longitudinal axis of sleeve 100. End surfaces 118 and 120 are thus of ellipitical configuration defining major and minor axes 119 and 121 and are oriented relative to the sleeve 100 such that the major axes 119 are in coplanar relation longitudinally of the sleeve and are also coplanar with and intersect the longitudinal center or midportion of slot 112 (see FIG. 6). It will also be noted that the end surface 118 forms sleeve 100 in the area of slot 112 to define an acute angled (45°) edge portion 123 while end surface 120 forms sleeve 100 in the area of slot 112 to define an obtuse angled (135°) edge portion 125, viewing sleeve 100 in plan with the surfaces 118 and 120 disposed normally of the line of sight (see FIG. 7).

Figure 7:
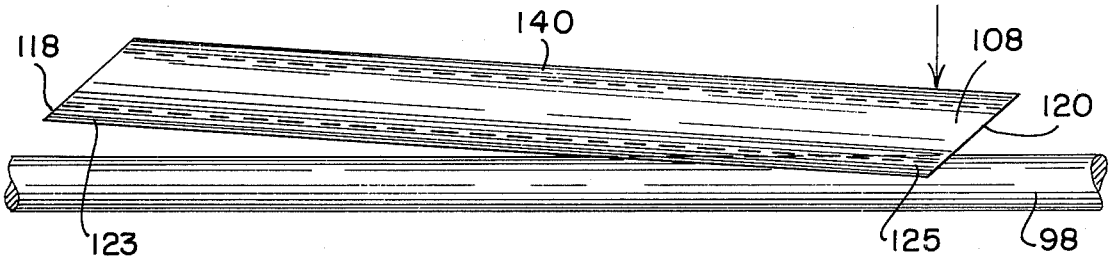
FIG. 7 is a view similar to that of FIG. 3, but showing diagrammatically the manner in which the sleeve is applied to the brake rod.

Sleeve 100 is applied to the brake rod by placing the sleeve slot cam surfaces 114 and 116 at sleeve edge portion 125 against the brake rod external surface 104, with the sleeve 100 as a whole disposed in the somewhat angled relation to the brake rod that is indicated in FIG. 7, and applying thrust pressures, as by employing hammer blows, against the uninterrupted side 140 of same in the direction indicated by arrow 127 of FIG. 7, to initially seat the brake rod within the sleeve 100 at its end 108. Complete insertion of the brake rod within the sleeve 100 is then effected by hammering the sleeve 100 against the rod and along its uninterrupted side 140 in a walking manner and moving to the left of FIG. 7.

As indicated in FIGS. 2 and 4, in accordance with the invention, the sleeve 100 in operation is positioned circumferentially of the rod segment 98 such that the sleeve slot 112 faces upwardly whereby the sleeve uninterrupted underside 140 rests on the surface 96 of support member 84 with which the sleeve is to cooperate. With the sleeve 100 disposed as indicated relative to the rod segment 98 and support member 84 in question, the retainer member 130 therefor is applied thereto in the manner indicated in FIGS. 2 and 3 so as dispose the retainer shank 132 in the sleeve slot 112, with retainer member end portions 134 and 136 thereby being brought into overlapping partially encompassing relation with the brake rod segment 98, and specifically its external surfacing 104. The sleeve 100 may be applied to a conveniently available section of the brake rod, and then slid along the rod to the location of its cooperating support member 82 for application thereto of retainer member 130.

In accordance with the present invention, the retainer member 130 is formed from a suitable metallic material for welding of the end portions 134 and 136 of same to the rod segment where indicated at 142 and 144, respectively. A material suitable for this purpose is 1020 steel.

Further in accordance with the invention, the sleeve 100 is of molded or extruded one-piece construction, and is defined by a high density polymer of dry self lubricating characteristics that is pliable but non-stretchable and has a high degree of elastic memory for full return to original shape after being stressed, up to its elastic limit.

Pursuant to the invention the sleeve 100 is formed from ultra high molecular weight (UHMW) polyethylene having a molecular weight in the range of from about 3 million to about 9 million. In specific embodiments of the invention conforming to this invention the sleeve 100 was made from the molecularly oriented UHMW polyethylene marketed by Ketrol Enterprises (of York, Pennsylvania) under the trademark TUFLAR (grade PL), which is the specific material preferred for practicing the invention; such material as shaped to define sleeve 100, conforms to the characteristics specified in this application, and thus has, among other aspects, a high degree of toughness and long wearing characteristics, in addition to being self lubricating. This material is also receptive to fillers in the form of glass, clay, sand, suitable fabrics, and alumina for modifying same to adapt the sleeve for specific conditions.

The polyethylene material indicated provides a sleeve 100 having surfacing that is characterized by resistance to adherence thereto of foreign matter, while being self-lubricating in nature and providing a coefficient of sliding or dynamic friction of the sleeve surface 140 on the support member surface 96 on the order of 0.02. The polymer material employed, in addition to being a high strength, dry self-lubricating, wear resisting material, also is characterized by effecting on the support member surfacing 96 a polishing or honing resurfacing action such that after a period of normal use, the surface 96 takes on a mirror like finish whereby the surface 96 in question becomes effectively resistant to further wear. What appears to happen is that, as sliding movement of sleeve 100 accurs relative to support surface 96, whether longitudinally or transversely of the brake rod, the polymer material of the sleeve tends to fill up the pores and level irregularties in the metal surfacing defining surface 96, so that surface 96 becomes partially formed by transferred polymer material from sleeve 100. Any foreign matter that is caught between the two surfaces 96 and 140 becomes embedded in the sleeve external surfacing, as does any metal fragments initially worn off the support member 82 in the area of surface 96; thus, such embedded material is positioned to avoid any wearing action on the surface 96. As indicated, since the material from which the sleeve is made resists adherence thereto of foreign matter, such foreign matter does not accumulate either on the sleeve or on the resurfaced portion of surface 96, and it is only grit and the like that becomes trapped between the two surfaces 96 and 140 that is subject to the embedding action indicated. Thus, the abrasive effect of foreign matter that is usually found in equipment of this type is avoided. In this connection, the term "foreign matter" means the dirt, grit, dust, road bed particles, and the like that under the car equipment is exposed to in service, as is well known in the art.

The resulting resurfacing of surface 96 means that the coefficient of sliding friction at the slip surface in question tends to decrease even below 0.02 as the polymer builds up on the surface 96.

It has also been found that the wear surface 140 of the sleeve 100, and the polymer resurfacing making up surface 96, tend to work harden in use, thus increasing the ability of the sleeve and rod support to resist wear.

Another characteristic of the material in question is that when the brake rods to which the support arrangement 80 are applied vibrate when the car is in motion, the material acts as a kinetic energy absorber and sound deadener, and with particular effectiveness since the polymer gradually builds up on the support surface 96 (to form the indicated mirror finish) and thus provides a two-way sound deadening and energy absorbing action.

In use, the riding position of the brake rod segment 98 and its associated sleeve 100 and retainer member 130 may be as indicated in FIGS. 2 and 3. When the car is moved along the track without braking, the brake segment 98 may vibrate horizontally and vertically, depending upon the oscillatory actions resulting from the movement of the car body in question, with the sleeve sometimes thus sliding back and forth across the surface 96 moving vertically or in a circular motion within the confines of the support member legs 84 and 86.

When the brakes are applied, the brake rod segment 98 moves either to the right or to the left of FIG. 2, depending upon the application, with the sleeve 100 thus moving perpendicular to the plane of the support member 84 across the surface 96 to the extent of the brake movement and release action following same, whereby the sliding action involved between the sleeve 100 and rod segment 98 is at the contacting portions of the surfaces 96 and 140.

It will therefore be seen that the invention provides a brake rod support arrangement of novel characteristics which avoids the use of both the conventional wear plate on which brake rods usually ride and wet lubricating materials to reduce wear on the brake rod. The brake rod segment 98 itself at the location of the support for the brake rod is completely protected from wear and the resurfacing that is affected of of the support member wear surface 96 establishes a resurfacing of same that eventually makes it define a wear resisting mirror-like surface.

The toughness of the material from which the sleeve is formed eliminates the need for brake rod motion hold down devices or components to be applied to the support member 84 to resist vibration, and the shock absorbing characteristics and sound deadening characteristics of the sleeve both protect the support member 84 and eliminate noise pollution for riders of the car to which the invention is applied.

As the sleeve 100 is applied to the brake segment 98 to dispose its slot 112 in the upwardly facing direction indicated in the drawings, the shank 132 of the retainer member is never subject to engagement with the support member 84.

The material from which the sleeve is formed insures the high strength, wear resisting, dry self-lubricating, low coefficient of dynamic friction characteristics that are desired for the sleeve component of this invention, while at the same time providing a material that resists flow under significant unit pressures and yet is sufficiently workable in nature to permit formation, as by injection molding or extrusion, of the product shape desired.

The invention is equally applicable to new and old equipment, and can be applied in the field. When applied to existing equipment, the conventional wear plate usually associated with the conventional support member may be disposed of and the support member surfacing on which the sleeve 100 is to ride suitably shaped to be reasonably flat and smooth. Where the brake rod segment 98 has undergone some wear, the sleeve 100 completely covers the worn area so that the brake rod in question can remain in service without further approaching the aforeindicated condemnation wear point sizing.

The showing of FIG. 1 is intended to illustrate diagrammatically a brake rigging arrangement commonly used in freight cars. However, the invention is obviously readily applicable to any rail car underside braking rigging arrangement employing brake rods of the type indicated.

While the sleeve 100 may be formed such that its end 106 has the end surface 118 forming an obtuse angle edge portion 125 rather than acute angle edge portion 123, the form illustrated is preferred as only one edge portion 125 is needed, and the sleeve end shaping involved facilitates manufacturing procedures. Of course, end surfaces 118 and 120 need not be totally planar as it is the general shaping that is important rather than strict flatness.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a railroad car including brake rigging employing a cylinder lever and a dead lever in spaced apart relation longitudinally of the car and each mounted to swing about a pivotal axis intermediate the ends of same, a brake cylinder operatively connected to the cylinder lever adjacent one end of same, and a brake rod operatively connected between the other end of the cylinder lever and brake shoes of the car truck at one end of the car, whereby actuation of the brake cylinder applies braking forces to the car truck wheels through the cylinder lever, the brake rod, and the brake shoes, and a hanger type support for the brake rod suspended from the car on which the brake rod rests and with respect to which the brake rod reciprocates longitudinally of said brake rod in a travel range when the brake cylinder is actuated, the improvement wherein:

said brake rod has applied thereto in the area of said support a sleeve formed from an ultra high molecular weight polymer of dry self lubricating characteristics characterized by having surfacing that resists adherence thereto of foreign matter, said sleeve riding on said support and being proportioned lengthwise thereof to extend to either side of said support at all positions of said brake rod relative to said support in said travel range, said sleeve being slotted longitudinally thereof along one side between the ends thereof, said sleeve being disposed to face said slot thereof upwardly, whereby the underside of said sleeve rides on said support, and a retainer member received in said slot, said retainer member having an end portion adjacent each end portion of said sleeve formed to embrace the upwardly facing side of said rod on either side of said sleeve slot, and means for making said retainer member end portions fast to said brake rod.

2. The improvement set forth in claim 1 wherein:

said material is characterized by resurfacing during operation of said brake rod the support surface engaged by said sleeve to reform same to have a wear free mirror finish.

3. The improvement set forth in claim 1 wherein:

said sleeve has a coefficient of sliding friction with the support that is no greater than about 0.02.

4. The improvement set forth in claim 1 wherein:

said polymer is polyethylene having a molecular weight lying in the range of from about 3,000,000 to about 9,000,000.

5. The improvement set forth in claim 1 wherein:
said slot of said sleeve is proportioned for snap fit application of said sleeve to said rod through said slot from one side of said rod.

6. The improvement set forth in claim 1 wherein:
said material is characterized by effecting deadening of rattling of the rod on the support during movement of the car.

7. The improvement set forth in claim 5 wherein:
said sleeve is formed to define a planar end surface at one end of same angled relative to the longitudinal axis of said sleeve to define an obtuse angle sleeve edging at said slot for thrust application of said sleeve onto said rod at said sleeve edging.

8. The improvement set forth in claim 7 wherein:
said sleeve end surface is of elliptical configuration with the major axis thereof intersecting said slot.

9. A brake rod support arrangement for railroad cars having brake rigging including one or more brake rods disposed on the underside of same through which braking forces are transmitted in being applied to the car truck wheels, said support arrangement comprising:
a U-shaped support member suspended from the car underside in inverted position,
a sleeve received on the rod and resting on said support,
said sleeve being formed from an ultra high molecular weight polymer of dry self lubricating characteristics characterized by having surfacing that resists adherence thereto of foreign matter,
said sleeve riding on said support member and being proportioned lengthwise thereof to extend to either side of said support member at all positions of said brake rod relative to said support,
said sleeve being slotted longitudinally thereof along one side thereof between the ends thereof,
said sleeve being disposed to face said slot thereof upwardly, whereby the underside of said sleeve rides on said support member,
and a retainer member received in said slot,
said retainer member having an end portion adjacent each end portion of said sleeve formed to embrace the upwardly facing side of said rod on either side of said sleeve slot,
and means for making said retainer member end portions fast to said brake rod.

10. The improvement set forth in claim 9 wherein:
said slot of said sleeve is proportioned for snap fit application of said sleeve to the brake rod through said slot from one side of the rod.

11. The improvement set forth in claim 10 wherein:
said sleeve is formed to define an end surface at one end of same angled relative to the longitudinal axis of said sleeve to define an obtuse angle sleeve edging at said slot for thrust application of said sleeve onto said rod at said sleeve edging, from the side of the rod.

12. The improvement set forth in claim 11 wherein:
said sleeve end surface is of elliptical configuration with the major axis thereof intersecting said slot.

13. The improvement set forth in claim 9 wherein:
said material is characterized by resurfacing during operation of said brake rod the support surface engaged by said sleeve to define a mirror finish that is at least partially made up by portions of said material transferred to said support member surface.

14. The improvement set forth in claim 9 wherein:
said sleeve has no more than a 0.02 coefficient of sliding friction with the support member.

15. In a railroad car including brake rigging employing a cylinder lever and a dead lever in spaced apart relation longitudinally of the car and each mounted to swing about a pivotal axis intermediate the ends of same, a brake cylinder operatively connected to the cylinder lever, and brake rods operatively connected between the cylinder lever and brake shoes of the car trucks, whereby actuation of the brake cylinder applies braking forces to the car truck wheels through the cylinder lever, the brake rods, and the brake shoes, and a hanger type support for the respective brake rods suspended from the car on which the respective brake rods rests and with respect to which the brake rods reciprocate longitudinally of said brake rods in a travel range when the brake cylinder is actuated, the improvement wherein:
said brake rods each have applied thereto in the area of the respective supports therefor a sleeve formed from an ultra high molecular weight polymer of dry self lubricating characteristics characterized by having surfacing that resists adherence thereto of foreign matter,
said sleeves riding on the respective supports and being proportioned lengthwise thereof to extend to either side of the respective supports at all positions of said brake rods relative to said supports in said travel range,
said sleeves being slotted longitudinally thereof along one side thereof between the ends thereof,
said sleeves being disposed to face said slots thereof upwardly, whereby the underside of the respective sleeves ride on the respective supports,
and a retainer member for each sleeve received in said slot thereof,
said retainer members each having an end portion adjacent each end portion of the respective sleeves formed to embrace the upwardly facing side of the respective rods on either side of said sleeve slots,
and means for making said end portions of the respective retainer members fast to said brake rod.

* * * * *